US008066828B2

(12) United States Patent
Nash et al.

(10) Patent No.: US 8,066,828 B2
(45) Date of Patent: Nov. 29, 2011

(54) METHOD FOR EFFICIENT HEAT TREATMENT OF STEEL

(75) Inventors: Philip Nash, Chicago, IL (US); Vivekanand Sista, Chicago, IL (US); Satyam Sahay, Pune (IN)

(73) Assignees: Tata Consultancy Services, Ltd., Mumbai (IN); Illinois Institute of Technology, Chicago, IL (US)

( * ) Notice: Subject to any disclaimer, the term of this patent is extended or adjusted under 35 U.S.C. 154(b) by 514 days.

(21) Appl. No.: 12/184,746

(22) Filed: Aug. 1, 2008

(65) Prior Publication Data

US 2009/0314396 A1 Dec. 24, 2009

(30) Foreign Application Priority Data

Jun. 18, 2008 (IN) ..... 1281/MUM/2008

(51) Int. Cl.
*C21D 6/00* (2006.01)
*C21D 9/00* (2006.01)

(52) U.S. Cl. ..... 148/511; 148/663; 148/664

(58) Field of Classification Search ..... 148/663, 148/511, 664
See application file for complete search history.

(56) References Cited

U.S. PATENT DOCUMENTS

| | | | | |
|---|---|---|---|---|
| 3,183,127 | A * | 5/1965 | Gregory et al. | 75/239 |
| RE27,505 | E * | 10/1972 | Grange et al. | 148/662 |
| 6,632,301 | B2 | 10/2003 | Krauss et al. | |
| 6,843,867 | B1 | 1/2005 | Foerster et al. | |
| 6,884,306 | B1 | 4/2005 | Mawella et al. | |
| 7,090,731 | B2 | 8/2006 | Kashima et al. | |
| 7,560,669 | B2 * | 7/2009 | Sahay et al. | 219/494 |
| 2008/0190522 | A1 * | 8/2008 | Volkmuth et al. | 148/664 |

FOREIGN PATENT DOCUMENTS

EP 0896068 * 8/2002

* cited by examiner

*Primary Examiner* — Deborah Yee
(74) *Attorney, Agent, or Firm* — Robert P. Michal; Lucas & Mercanti, LLP

(57) ABSTRACT

A method for heat treatment of steel and a system thereof is provided. First the steel is austenitized at a suitable temperature and then the temperature is rapidly brought down to the austempering temperature. Here the cyclic austempering is carried out between two austempering temperatures by modulating the temperature with controlled heating and cooling and the controlled temperature modulation is obtained by controlling the temperature-time profile in a batch furnace or by controlling the zone temperatures in a continuous furnace. This method of cyclic austempering reduces the austempering time, reduces the energy consumption and emissions, enhances the productivity and reduces the process cost.

14 Claims, 3 Drawing Sheets

METHOD FOR EFFICIENT HEAT TREATMENT OF STEEL

FIELD OF THE INVENTION

The present invention relates to heat treatment of steel and also to efficient austempering of steel

BACKGROUND OF THE INVENTION

Austempering is a commercially important heat treatment operation, where strong and tough bainitic steel is produced in a single heat treatment. During the austempering process, the steel is first austenitized and then cooled rapidly to just above the martensite start temperature until bainite nucleates and grows, usually until the transformation stops and then it is cooled to room temperature. Due to the sluggish solid state transformation kinetics, industrial austempering necessitates isothermal holds of 2 to 24 hrs, depending on the size and composition of steel. The conventional austempering process is carried out at a constant (isothermal) temperature. The duration of the austempering process as well as the resultant microstructure depends on the holding temperature and component size.

PRIOR ART

U.S. Pat. No. 6,632,301 teaches bainitic steel doctor blades, bainitic steel coating blades, bainitic steel creping blades and bainitic steel rule die knives used in gravure printing, flexographic printing, paper making, die cutting of materials including paper, plastic, foam, leather, etc. Other uses include printing processes such as pad printing and electrostatic printing. The invention also includes an improved method for producing bainitic steel strip. It is accomplished by using bainitic steel components that exhibit superior straightness and wear properties and are bendable around small radii. The process of the present invention comprises the steps of annealing a carbon steel resulting in a microstructure of the steel having a dispersion of carbides in a ferritic matrix; cold rolling the annealed steel; cleaning the cold rolled steel to remove oil and dirt; bridle braking the cleaned steel to increase strip tension; austenitizing the steel; submersing the austenitized steel into a quenchant; removing excess quenchant; and isothermally transforming the austenitized steel into bainite. The present process also includes the use of turn rolls that are housed in an assembly containing salt and/or tin.

U.S. Pat. No. 6,843,867 describes a method of austempering of steel parts. The steel parts are initially austenitized and subsequently quenched to a start temperature which is higher than the martensite start temperature. Then the steel parts are subjected to a first isothermal holding at the start temperature for a first time period. Subsequently the steel parts are held for a second isothermal time period at a finish temperature which is higher than the start temperature. The method described is particularly well suited for rapid austempering of steel parts, a pure bainitic structure being achievable, and the core hardness of the steel parts obtained being settable via the start temperature, the finish temperature, the duration of the first time period, and the duration of the second lime period.

U.S. Pat. No. 6,884,306 describes a method of heat treating a steel to produce a mainly bainitic structure, wherein the steel has the following composition in weight percent; carbon 0.6-1.1; silicon 1.5 to 2.0; manganese 1.8 to 4.0; chromium 1.2 to 1.4; nickel 0-3; molybdenum 0.2 to 0.5; vanadium 0.1 to 0.2, balance iron save for incidental impurities; and wherein the method comprises the steps of: homogenising the steel at a temperature of at least 1150.degree. C. for at least 24 hours; air cooling the steel; subjecting the steel to a temperature between 900.degree. C. and 1000.degree. C.; isothermally transforming the steel at a temperature between 190.degree. C. and 260.degree. C. for 1 to 3 weeks.

U.S. Pat. No. 7,090,731 further tells us about a high strength steel sheet having (2-1) a base phase structure, the base phase structure being tempered martensite or tempered bainite and accounting for 50% or more in terms of a space factor relative to the whole structure, or the base phase structure comprising tempered martensite or tempered bainite which accounts for 15% or more in terms of a space factor relative to the whole structure and further comprising ferrite, the tempered martensite or the tempered bainite having a hardness which satisfies the relation of Vickers hardness (Hv).gtoreq.500[C]+30[Si]+3 [Mn]+50 where [ ] represents the content (mass %) of each element, and (2-2) a second phase structure comprising retained austenite which accounts for 3 to 30% in terms of a space factor relative to the whole structure and optionally further comprising bainite and/or martensite, the retained austenite having a C concentration (C.gamma.R) of 0.8% or more.

All the methods for austempering in the existing knowledge require a large austempering time and consume a lot of energy. Thus, there is a need for a method for austempering of steel which is economical, requires less time and is energy efficient.

OBJECTS OF THE INVENTION

The objective of this invention is to provide a method for substantially reducing the austempering time.

It is an object of this invention to enhance the productivity of the austempering operation.

Another objective of the invention is to reduce the energy consumption during the austempering operation.

Another objective of this invention is to reduce the emissions from the austempering operation.

Another objective of this invention is to reduce the cost of the austempering operation.

SUMMARY OF THE INVENTION

In accordance with this invention there is provided a method for efficient austempering of steel. The method comprises the following steps,

- austenitizing the steel at a suitable temperature;
- rapidly bringing it to the austempering temperature;
- caring out cyclic austempering between two austempering temperatures by modulating the temperature with controlled heating and cooling; and
- the controlled temperature modulation can be obtained by controlling the temperature-time profile in a batch furnace or by controlling the zone temperatures in a continuous furnace.

The method in accordance with this invention significantly reduces the austempering time. In this method, the steel is austenitized, rapidly cooled to the austempering temperature above martensite start temperature and cyclically austempered at the desired temperature. As opposed to conventional austempering at a constant temperature, in the cyclic austempering process the temperature is modulated between two predetermined temperatures with a controlled thermal frequency and amplitude. The benefit of this method is demonstrated for 1080 steel, where 80% reduction in austempering time is achieved by replacing conventional constant temperature austempering at 260° C. with cyclic austempering carried out between 260-300° C. with heating and cooling rates of 1, 5 and 10° C./min between these temperatures. Significant reduction in energy consumption and emissions as well as enhancement in productivity can be achieved by this method. This will result in significant cost reduction of the austempering process.

The cyclic austempering process takes significantly lower time as compared to the prevalent isothermal austempering process. A time reduction of up to 80% is achieved. The reduction in austempering time during cyclic austempering significantly reduces the energy consumption of the austempering operation. The shorter austempering time during cyclic austempering significantly reduces the emissions resulting from the austempering operation. The shorter austempering time during cyclic austempering also significantly enhances the productivity of the austempering operation. The austempering method as described in this invention reduces the overall cost of the austempering operation.

In accordance with one aspect of the invention there is provided a method for heat treatment of steel comprising the steps (a) austenitizing the specimen at a suitable temperature
(b) rapidly cooling it to the austempering temperature
(c) performing cyclic austempering between two austempering temperatures by modulating the temperature with controlled heating and cooling
(d) Achieving controlled temperature modulation

*Please note that this system is not an invention made by us. We are testing our invention in this experimental thermo-mechanical simulator*

The features and advantages of the present invention will become more apparent from the ensuing detailed description of the invention taken in conjunction with the accompanying drawings

BRIEF DESCRIPTION OF THE ACCOMPANYING DRAWINGS

DETAILED DESCRIPTION OF THE ACCOMPANYING DRAWINGS

A method for efficient austempering of steel is described in the present invention. The method comprises the steps of austenitizing the steel at a suitable temperature; rapidly bringing it to the austempering temperature; carrying out cyclic austempering between two austempering temperatures by modulating the temperature with controlled heating and cooling; the controlled temperature modulation being obtained by controlling the temperature-time profile in a batch furnace or by controlling the zone temperatures in a continuous furnace.

The method in accordance with this invention significantly reduces the austempering time. As opposed to conventional austempering at a constant temperature, in the cyclic austempering process the temperature is modulated between the two temperatures with a controlled thermal frequency and amplitude. The benefit of this method is demonstrated for 1080 steel, where 80% reduction in austempering time is achieved by replacing conventional constant temperature austempering at 260° C. with cyclic austempering carried out between 260-300° C. with heating and cooling rates of 1, 5 and 10° C./min between these temperatures. Significant reduction in energy consumption and emissions as well as enhancement in productivity can be achieved by this method. This results in significant cost reduction of the austempering process.

The following experiments illustrate the principles of this invention. Austempering kinetics experiments were performed on 6 mm diameter cylindrical samples of 1080 steel using a Gleeble™ 3500 thermo-mechanical simulator (DSI Poestenkill, N.Y.). In this method, a diametrical dilatometer was mounted on the specimen to measure the diameter change during the thermal processing. The thermo-mechanical simulator has the capability to very accurately simulate variety of hot-working and heat treatment operations. In the present work, the percentage of bainitic transformation as a function of time was computed from the dilation curve in conjunction with the microstructural examination by optical microscopy and scanning electron microscopy.

Figure 1:
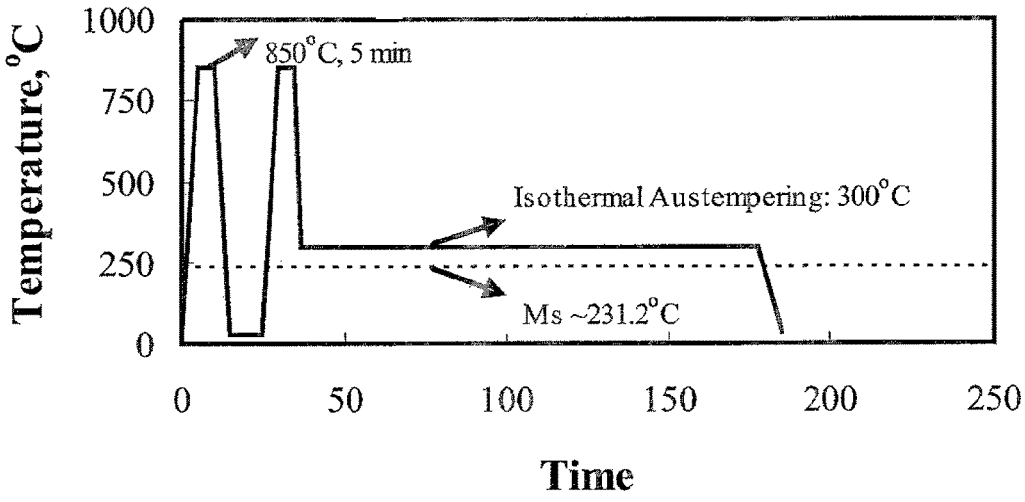
FIG. 1 illustrates a schematic temperature time profile for the conventional isothermal austempering experiment.
Figure 2:
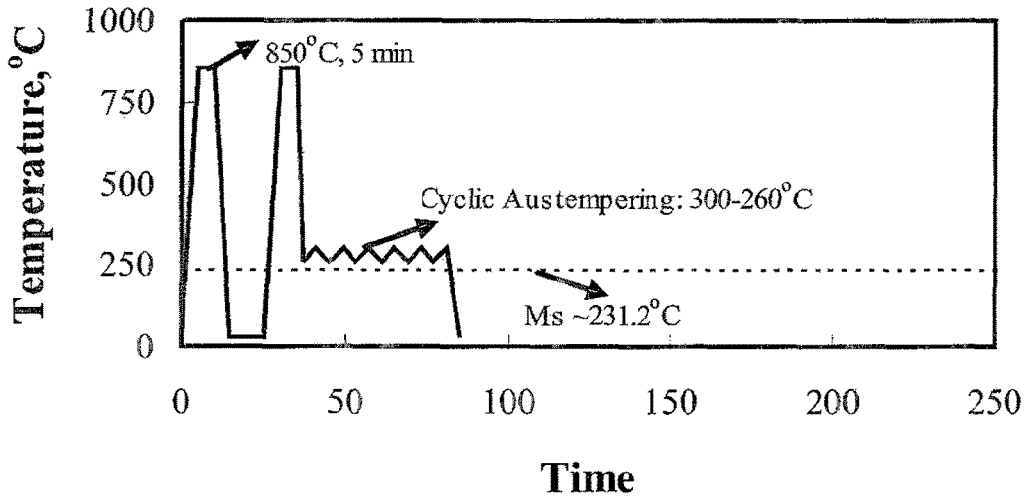
FIG. 2 illustrates a schematic temperature time profile for the cyclic austempering experiment in accordance with this invention.
Figure 3:
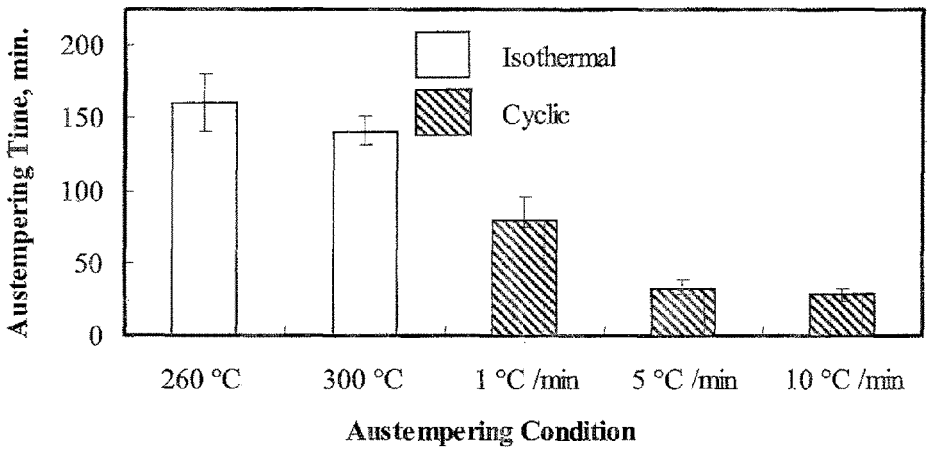
FIG. 3 illustrates a comparison of austempering time between isothermal and cyclic austempering experiments carried out under different conditions.

The austempering experiments were performed in two cycles as illustrated in FIG. 2. The first cycle provides the same initial microstructure prior to each experiment. After completing the first cycle, the cylindrical specimens were heated to the austenitizing temperature (850° C.), held for 5 minutes and then cooled to different austempering temperatures, where the bainite transformations were monitored for the desired period of time, followed by cooling to room temperature. The cooling rates were sufficiently fast to avoid any transformation occurring before reaching the austempering temperature.

The isothermal experiments were carried out at austempering temperatures of 260 and 300° C. The austempering was found to be complete after 160 minutes at 260° C. and after 140 minutes at 300° C. The bainitic microstructures were observed in the isothermally austempered samples.

In the cyclic austempering experiments, the temperature was modulated between 260 and 300° C. The heating and cooling between these two temperature ranges were maintained constant at 1, 5 and 10° C. per minute. It is noted that the cyclic austempering experiments require significantly shorter time. For example, when the cyclic austempering is carried out at 5° C./min, the austempering is complete in 32 minutes. The microstructure of the cyclically austempered sample also revealed bainite structure.

It can be seen that the cyclic austempering is significantly faster and efficient than isothermal austempering. As compared to isothermal austempering at 260° C., the austempering time reduces by over 80% during cyclic austempering between 260-300° C. at 5° C./min heating and cooling rate.

The productivity of the austempering operation can be significantly enhanced due to reduction in austempering time. Furthermore, it also results in energy reduction, emissions reduction and overall cost reduction during the industrial austempering process.

The efficient cyclic austempering described above is applicable to all the steels which can be austempered. In the industrial scenario, the cyclic austempering can be carried out either in a batch furnace by varying the temperature with time or in a continuous furnace by setting different zone temperatures.

While considerable emphasis has been placed herein on the various components of the preferred embodiment, it will be appreciated that many alterations can be made and that many modifications can be made in the preferred embodiment without departing from the principles of the invention. These and other changes in the preferred embodiment as well as other embodiments of the invention will be apparent to those skilled in the art from the disclosure herein, whereby it is to be distinctly understood that the foregoing descriptive matter is to be interpreted merely as illustrative of the invention and not as a limitation.

The invention claimed is:

1. A method for heat treatment of steel comprising the steps of:

a. austenitizing a steel specimen at a suitable temperature;

b. selecting a lower austempering temperature and a higher austempering temperature;

c. rapidly cooling the austenitized steel specimen to the lower austempering temperature; and d. austempering the cooled steel specimen by controlled temperature modulation by cyclically heating and cooling the steel specimen between the lower and the higher austempering temperatures.

2. The method of claim 1, wherein the steel specimen is 1080 steel.

3. The method as claimed in claim 1, wherein the austempering step is carried out in at least two cycles of heating and cooling.

4. The method of claim 1, wherein the austenitizing step includes heating the steel specimen to 850° C. and holding the heated steel specimen for 5 minutes.

5. The method of claim 1, wherein bainite transformations are monitored during each of the lower and the higher austempering temperature temperatures.

6. The method of claim 1, further comprising a step of cooling the steel specimen to room temperature after austempering.

7. The method of claim 1, wherein the cooling of the steel specimen to one of the austempering temperatures is fast to avoid transformation occurring before reaching the austempering temperature.

8. The method of claim 1, wherein the selected austempering temperatures are between 260° C. and 300° C.

9. The method as claimed in claim 1, wherein the cyclic heating and cooling between the lower and the higher austempering temperature temperatures is maintained continuously for 1, 5 or 10° C. per minute.

10. The method as in claim 1, wherein the cyclic austempering by modulating temperatures is carried out either in a batch furnace by varying the temperatures with time or in a continuous furnace by setting different zone temperatures.

11. The method of claim 1, wherein the step of austempering is done with controlled thermal frequency and amplitude.

12. The method of claim 1, wherein energy consumption and emission levels are less.

13. The method of claim 1, wherein austempering time is reduced.

14. The method of claim 1, wherein enhanced productivity is achieved at low cost.

* * * * *